US005714724A

United States Patent [19]

Menzel

[11] Patent Number: 5,714,724

[45] Date of Patent: Feb. 3, 1998

[54] MUFFLER MOUNTED IN A PIPE

[75] Inventor: Johannes Menzel, Stuttgart, Germany

[73] Assignee: Andreas Stihl, Waiblingen, Germany

[21] Appl. No.: 685,827

[22] Filed: Jul. 25, 1996

[30] Foreign Application Priority Data

Jul. 25, 1995 [DE] Germany ..... 295 11 979.9

[51] Int. Cl.[6] ..... F02M 35/00

[52] U.S. Cl. ..... 181/229; 181/268

[58] Field of Search ..... 181/224, 227, 181/228, 229, 230, 217, 264, 268, 277, 281

[56] References Cited

U.S. PATENT DOCUMENTS

| | | | |
|---|---|---|---|
| 4,934,482 | 6/1990 | Herron et al. | 181/224 |
| 4,936,413 | 6/1990 | Lee | 181/264 |
| 4,966,253 | 10/1990 | Stephens et al. | 181/227 |

FOREIGN PATENT DOCUMENTS

| | | |
|---|---|---|
| 3819728 | 1/1989 | Germany . |

*Primary Examiner*—Khanh Dang
*Attorney, Agent, or Firm*—Walter Ottesen

[57] ABSTRACT

The invention is directed to a muffler for insertion into a pipe such as the intake pipe of an internal combustion engine. The muffler includes a base body defining a longitudinal axis and having first and second axial end faces. The base body has a plurality of pass-through openings formed therein which extend between the first and second end faces of the base body in the direction of the longitudinal axis. The base body is delimited by a radially outer-lying surface and has a support section in the region of the outer-lying surface. The support section extends axially beyond the first end face and is the maximum projection extending beyond the first end face of the base body.

15 Claims, 3 Drawing Sheets

MUFFLER MOUNTED IN A PIPE

FIELD OF THE INVENTION

The invention relates to a muffler mounted in a pipe such as an intake muffler in the intake pipe of internal combustion engine.

BACKGROUND OF THE INVENTION

German Patent 3,819,728 discloses an intake muffler which is inserted into the pipe inlet in the region of the free end face of the intake pipe. Pass-through openings are provided in the muffler and are distributed over the cross section. The inducted air is guided through these pass-through openings. Disturbing flow noises are reduced by imparting turbulence to the inducted air and by the interference of standing sound waves.

The muffler has radially projecting flanges to ensure reliable attachment of the muffler at the pipe inlet and to delimit the insert depth into the pipe. The projecting flanges lie in contact engagement with counter flanges on the end face of the intake pipe and are connected thereto with threaded fasteners. The flanges, which lie radially outside of the pipe wall, require additional space to accommodate the same. Furthermore, it is disadvantageous that the flanges of the muffler as well as those of the intake pipe must be attached with complex measures to the respective components.

SUMMARY OF THE INVENTION

It is an object of the invention to provide a muffler with constructively simple means so that the insert depth of the muffler into a sound-conducting pipe, and especially in the region of the pipe elbow, is delimited without measures requiring space.

The muffler of the invention is for insertion into a pipe and includes: a base body defining a longitudinal axis and having first and second axial end faces; the base body having a plurality of pass-through openings formed therein which extend between the first and second end faces in the direction of the longitudinal axis; the base body being delimited by a radially outer-lying surface; the base body having a support section in the region of the outer-lying surface and the support section extending axially beyond the first end face; and, the support section being the maximum projection extending beyond the first end face.

The support section of the base body abuts against a restriction provided within the pipe when the muffler is introduced therein. The restriction can, for example, be a support shoulder which is provided because of a flattening of the pipe cross section. The restriction defines a stop for the muffler inserted into the pipe which can then not be inserted beyond this position. The support is defined exclusively by the restriction provided in the pipe interior. Outside of the pipe, there are no devices necessary for attaching the muffler which would need extra space.

The support section is advantageously formed with the base body as a single component and extends over an angular range of approximately 90° along the outer surface of the base body with this angular range being measured with reference to the longitudinal axis. The support section of the muffler is formed in the outer wall surface of the base body of the muffler. This support section is in contact engagement with the inner wall surface of the pipe and is braced on the support shoulder of the pipe without significantly reducing the flow path. This is especially the case for a cylindrical base body and a cylindrical pipe having a cross section flattened on one side.

The axial extent of the support section, which extends beyond the end face of the base body, is preferably greater than the axial length of the base body itself. It is thereby possible to fix the base body in direct proximity of the pipe inlet. The support section extends far into the pipe up to a restriction, for example, the support shoulder or the pipe elbow.

An axially extending longitudinal slot can be introduced into the outer surface of the support section which is open outwardly. A latch key or raised portion on the inside wall surface of the pipe engages the longitudinal slot and ensures that the muffler can be inserted into the pipe in the prescribed angular position without rotating and tilting.

The base body of the muffler is advantageously part of a hollow cylinder. The base body is provided in an end section of the hollow cylinder and the end face facing toward the support section of the base body also defines an end face of the hollow cylinder. A reliable introduction of a muffler into the pipe is ensured because of the enlarged outer surface of the hollow cylinder. The end face of the hollow cylinder, which lies opposite the base body, is bevelled at an angle of approximately 20°. The delimiting plane of the end face is inclined in the direction of the support section. The muffler then has a maximum projection on the end face of the base body in the region of the support section; whereas, on the opposite lying end face, a wall section of the hollow cylinder displaced by 180° projects axially beyond the base body. The muffler is inserted into the pipe and the bevelled end face of the muffler extends with the projecting wall region out of the inlet opening of the pipe and defines an air scoop for the air to be inducted or the projecting wall closes flush with the open end of the tube which is likewise bevelled.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
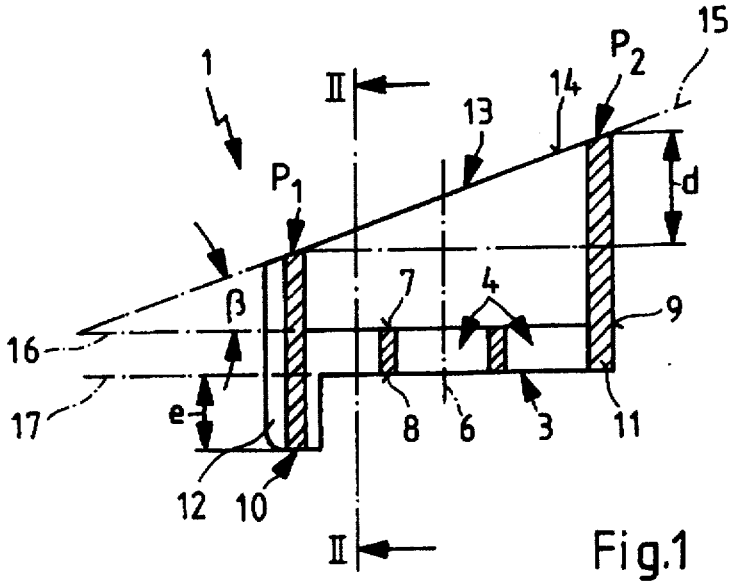
FIG. 1 is a side elevation view, in section, of an embodiment of the muffler according to the invention.

The muffler 1 shown in FIG. 1 includes a cylindrical base body 3 having a diameter adapted to the inner diameter of the pipe accommodating the muffler. Pass-through openings 4 are introduced into the base body 3 and extend in the direction of the longitudinal axis 6 of the base body. When the muffler is seated in the pipe, the fluid flows through the pass-through openings 4 into the pipe and the muffler, on the one hand, effects turbulence in the flow so that the flow noises are reduced, and, on the other hand, causes a partial elimination of standing waves by interference in the internal space of the pipe. The muffler 1 is suited especially as an intake muffler in the intake pipe of an internal combustion engine such as a two-stroke engine in a portable handheld work apparatus such as a motor-driven chain saw or the like.

The cylindrical base body 3 has two axial end faces (7, 8) and is enclosed by a cylindrical wall which defines an outer surface 9. An axially projecting support section 10 having an axial length (e) is provided on the end face 8 of the base body 3. The support section 10 on this end of the base body 3 defines the highest projection in the direction of the longitudinal axis 6. When the muffler is inserted into a pipe having a stop therein, the support section abuts against the stop in the pipe interior so that the muffler is fixed in this position.

Figure 6:
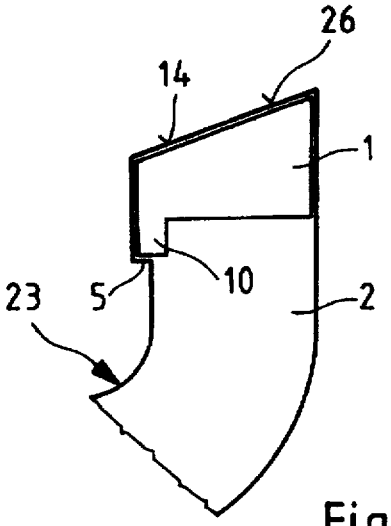
FIG. 6 is a schematic showing the muffler seated in a pipe.
Figure 7:
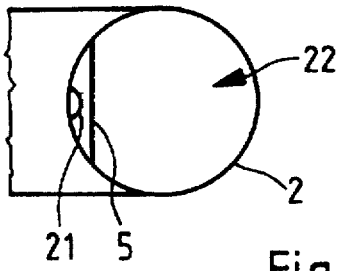
FIG. 7 is a plan view of the pipe of FIG. 6.

Referring to FIGS. 6 and 7, the stop can be provided in the form of a support shoulder 5 which is produced by flattening the round cross section at one side thereof. The flattened pipe section is axially spaced from the open end 26 of the intake pipe. The muffler 1 has an approximately circular cross section and can be inserted into the pipe up to where the support section 10 abuts against the support shoulder 5 formed by the flattening in the pipe. A further displacement of the muffler beyond this position is prevented. The pipe section with the flattened cross section extends approximately up to the beginning of the curvature of the pipe elbow 23. No wall section which extends beyond the plane 17 of the end face 8 is provided on the side radially opposite the support section 10. This region lies on the interior wall surface of the pipe lying opposite the stop.

The support section 10 is advantageously formed as a single component with the base body 3 and extends over an angular range α of approximately 90° along the outer surface 9 of the base body 3 (FIG. 5) with the angular range being referred to the longitudinal axis 6. This angular range is, on the one hand, sufficiently large so that a surface guidance of the support section 10 with its outer surface 9' is ensured in the interior of the pipe, while, on the other hand, the cross section within the interior of the pipe is not affected by the support section.

Figure 2:
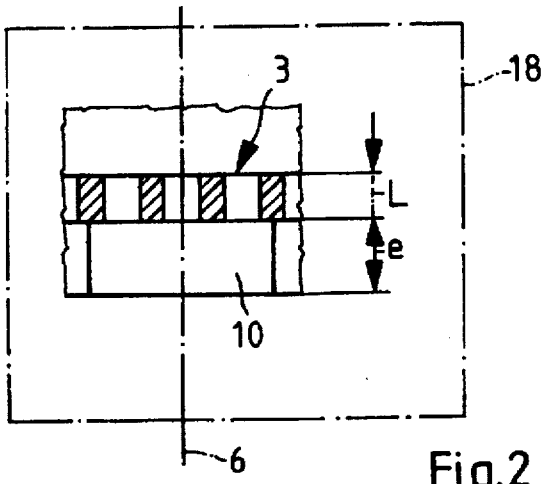
FIG. 2 is a section view of the muffler taken along section line II—II of FIG. 1.

As shown in FIG. 2, the axial extent (e) of the support section 10 is greater than the axial length L of the base body 3. This has especially advantages when the base body 3 is disposed close to the pipe inlet and must nonetheless ensure that the support section 10 is supported on a stop located farther within the pipe.

A longitudinal slot 12 is provided on the radially outer-lying surface 9' of the support section 10 so that it extends in the direction of the longitudinal axis 6. The longitudinal slot 12 opens outwardly and has a semicircular cross section. As shown in FIG. 7, a complimentary latch key 21 is formed on the inner surface of the pipe wall so as to be complementary to the longitudinal slot 12. The muffler 1 is so inserted into the pipe that the longitudinal slot 12 is guided on the latch key 21 within the pipe 2. The longitudinal slot 12 extends over the entire axial length of the muffler in the region of the support section 10. The relative angular position of the muffler with respect to the pipe cross section is then clearly fixed so that an unwanted rotation of the muffler in the pipe is not possible.

Figure 8:
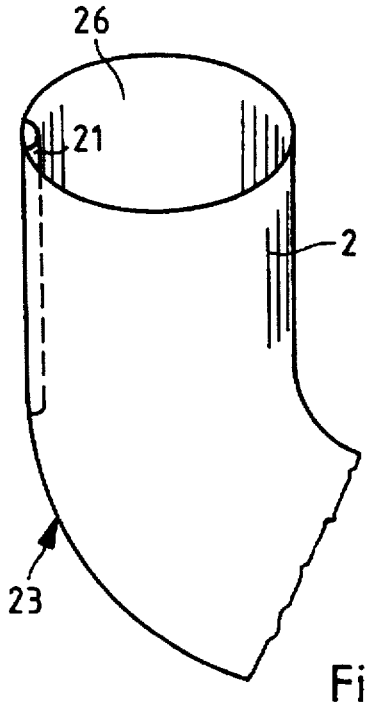
FIG. 8 is a perspective view of the pipe showing the latch key formed on the inner wall surface thereof.

According to FIG. 8, the latch key 21 extends from the inlet opening 22 up to the beginning of the curvature of the pipe elbow 23 on the radially outer-lying end of the pipe elbow.

If required, it can be sufficient to configure the latch key 21 as a latch cam so that the muffler has only a point-shaped guide in lieu of a linearly-shaped guide. The rotational position of the muffler is nonetheless clearly determined.

According to a further embodiment of the invention (not shown), it can be advantageous to configure the longitudinal slot 12 so that it is located axially only in the region of the support section 10. The axial end portion of the longitudinal slot can define a stop at the transition region of the outer surface of the base body whereat the latch key of the pipe can abut to delimit the insertion length of the muffler.

The outer surface lies tightly against the interior wall surface of the pipe so that unwanted flows are avoided and the muffler is seated tightly in the pipe uninfluenced by vibrations. The muffler is advantageously made of plastic and can have an overdimension compared to the cross section of the pipe.

The muffler is advantageously inserted so far into the pipe that standing waves in the pipe are eliminated by interference in the disturbing frequency range which occurs primarily in the pipe. Projected on a longitudinal plane 18 lying in the longitudinal axis 6, the support section 10 has a rectangularly-shaped cross section as shown in FIG. 2. This form is easy to manufacture and exhibits a sufficiently high stability.

Figure 3:
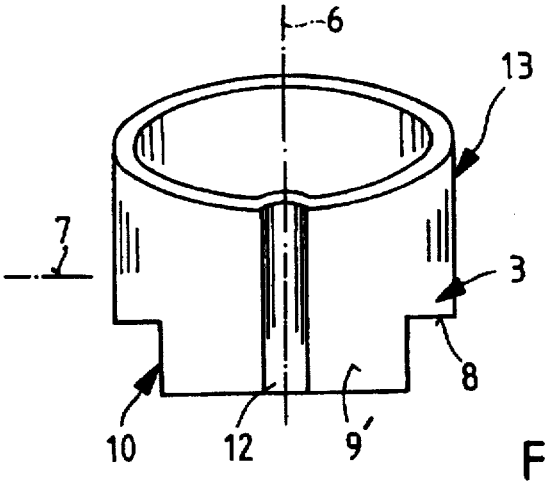
FIG. 3 is a perspective view of the muffler of the invention shown in FIGS. 1 and 2.

The base body 3 is part of a hollow cylinder 13 (FIGS. 1 and 3). The end face 8 of the base body 3, on which the support section 10 is provided, defines, at the same time, an end face of the hollow cylinder 13. The opposite-lying end face 7 of the base body 3 then lies at the base of the hollow cylinder 13.

The end face 14 of the hollow cylinder 13, which lies opposite the support section 10, is bevelled at an angle β of preferably approximately 20°. The delimiting plane 15 of the end face 14 and an end face plane 16 of the base body 3 then conjointly define the angle β. The delimiting plane 15 is therefore advantageously inclined in the direction of the support section 10 so that the axial lengths of the radially opposite-lying wall regions of the hollow cylinder 13 are approximately the same length. This affords the advantage shown in FIG. 6 that the end face 14 of the muffler 1 is almost flush with the open end 26 of the intake pipe 2 which is bevelled at approximately the same angle.

The end face 14 can be aligned in any desired angular position with respect to the angle β of inclination as well as to the direction of the delimiting plane in dependence upon the direction of the air to be guided into the muffler. This affords especially advantages when the open end 26 of the intake pipe 2 is aligned at right angles to the outer surface of the pipe wall as shown in FIG. 8 and the bevelled end face of the muffler projects out from the pipe and defines an air scoop which conducts the laterally inflowing air into the interior space of the pipe.

As a consequence of the bevelling of the end face 14 of the hollow cylinder 13, the radially opposite-lying points $P_1$ and $P_2$ lie on the end face 14 of the hollow cylinder with minimum and maximum spacings to the plane 16 of the base body 3. The difference of these axial distances is identified by reference character (d) as shown in FIG. 1. The axial extent (e) of the support section 10 is, in this embodiment, is less than this axial difference (d).

In another embodiment, (not shown), the base body is mounted in the interior space of the hollow cylinder so that cylinder wall regions of the hollow cylinder extend at both ends of the base body. It can furthermore be advantageous to provide a bevelled end face of the hollow cylinder in lieu of the outwardly projecting support section.

Figure 4:
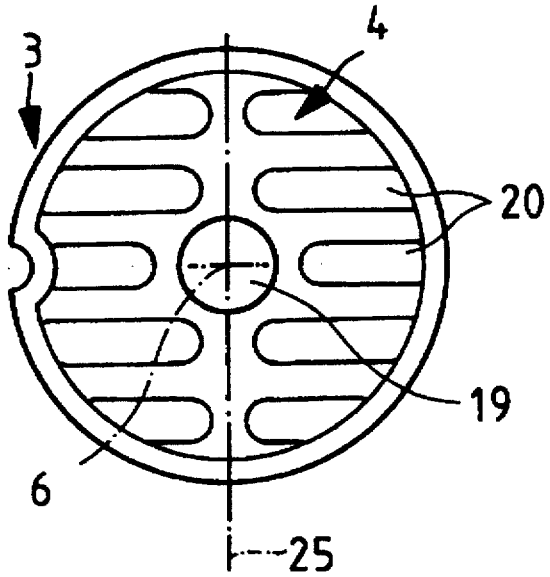
FIG. 4 is a top plan view of the muffler.
Figure 5:
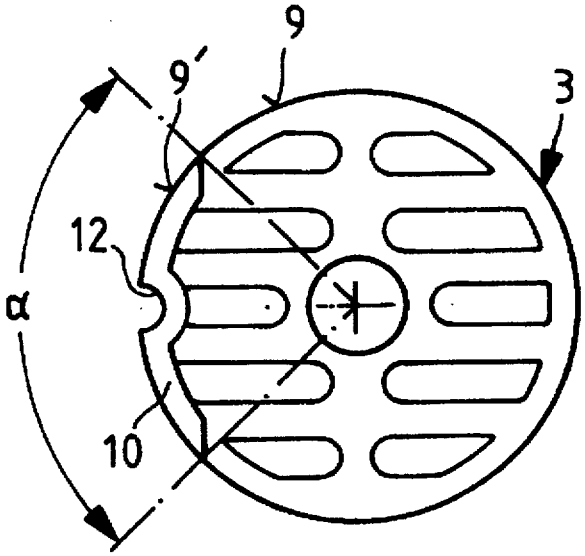
FIG. 5 is a bottom plan view of the muffler.

The pass-through openings 4 are configured in the base body 3 as shown in FIGS. 4 and 5 and include a central flow-through channel 19 and additional channels 20 at a radial spacing to the longitudinal axis 6. The central channel 19 extends along the longitudinal axis 6 and has a circularly-shaped cross section. The throughflow resistance of the muffler is reduced by drilling of the central channel 19. The radially spaced channels 20 have a slot-shaped cross section and the slots all are aligned in the same direction, but can have different lengths. The slots extend up to the wall of the base body and there are a total of ten slots formed in the base body 3. Sets of five slots are arranged symmetrically to the longitudinal center plane 25.

It can also be advantageous to insert the muffler into a pipe having a pipe elbow as shown in FIG. 8 in such a manner that the support section is defined by the outer end of the pipe elbow.

The support section extends axially beyond an end face of the base body and abuts against the radially outer-lying end of the pipe elbow when the muffler is introduced into the pipe. The muffler cannot be pushed further into the pipe beyond this position. The end of the base body lying radially opposite the support section includes a slight axial projection which extends beyond the end face so that the flow cross section of the pipe remains essentially unaffected by the muffler on the inner-lying end of the pipe elbow. The pipe flow can develop essentially unimpeded through the muffler in the pipe. At the same time, an effective noise reduction by interference and flow turbulence is effected. The muffler can be seated completely within the pipe so that no space-consuming devices are needed to attach the muffler at the pipe inlet. The support section is seated on the interior wall surface of the radially outer-lying elbow thereby securely holding the muffler.

The latch projection extending on the inner side of the pipe is advantageously arranged on the wall interior surface of the pipe in the region of the inlet opening in this embodiment. This wall interior surface of the pipe extends from the radially outer-lying wall of the pipe elbow.

It is understood that the foregoing description is that of the preferred embodiments of the invention and that various changes and modifications may be made thereto without departing from the spirit and scope of the invention as defined in the appended claims.

What is claimed is:

1. A muffler assembly comprising:

a muffler;

an air-intake pipe for receiving said muffler inserted therein;

said air-intake pipe having an interior and a cross section;

said muffler including a cylindrical base body defining a longitudinal axis and having first and second axial end faces;

said base body having a plurality of pass-through openings formed therein which extend between said first and second end faces in the direction of said longitudinal axis;

said base body having a cylindrical outer surface defining a plane;

said base body having an appending support section extending axially beyond said first end face approximately in said plane;

said support section being formed as a single component with said base body and said support section extending over an angular range (α) in the peripheral direction of said outer surface of said base body;

said support section having an external surface likewise extending over said angular range (α) and, on the one hand, said angular range (α) being selected to be sufficiently large so that a surface guidance of said support section with said external surface thereof is ensured in said interior of said air-intake pipe while, on the other hand, said cross section within said interior of said air-intake pipe is not affected by said support section so that no significant reduction in flow path occurs; and, said air-intake pipe having a support shoulder formed therein for supporting said support section thereon when said muffler is inserted into said air-intake pipe thereby limiting the depth to which said muffler can be inserted into said air-intake pipe.

2. The muffler assembly of claim 1, said base body having an axial length; said angular range (α) being approximately 90° referred to said longitudinal axis; and, said support section extending in the direction of said longitudinal axis an amount greater than said axial length of said base body.

3. The muffler assembly of claim 1, said support section having an axial longitudinally extending slot formed therein; and, said air-intake pipe having a key formed therein for engaging said slot when said muffler is inserted into said air-intake pipe.

4. The muffler assembly of claim 1, said base body having a central through-flow channel; and, said plurality of pass-through openings being disposed around said central through-flow channel at a radial spacing from said central through-flow channel.

5. The muffler assembly of claim 4, said plurality of pass-through openings being arranged on a common circle about said longitudinal axis.

6. The muffler assembly of claim 1, wherein said air-intake pipe is an air-intake pipe of an internal combustion engine.

7. The muffler assembly of claim 1, said plurality of pass-through openings being arranged on a common circle about said longitudinal axis.

8. A muffler for insertion into a pipe, the muffler comprising:

a base body defining a longitudinal axis and having first and second axial end faces;

said base body having a plurality of pass-through openings formed therein which extend between said first and second end faces in the direction of said longitudinal axis;

said base body having a cylindrical outer surface;

said base body having an appending support section extending therefrom axially beyond said first end face;

a cylindrical annular wall extending upwardly from said second end face and incorporating said base body and said support section as a part thereof;

said cylindrical annular wall having a cylinder end face facing away from said first end face;

said cylinder end face defining a first plane and said second face of said base body defining a second plane; and, said first and second planes conjointly defining an angle (β).

9. The muffler of claim 8, said angle (β) being about 20°.

10. The muffler of claim 8, said first plane being inclined toward said support section.

11. The muffler of claim 8, said cylindrical annular wall having a highest point measured from said second end face and lying in said first plane and a lowest point measured from said second end face and lying in said first plane; said highest point being spaced from said lowest point a first distance (d) measured in the direction of said longitudinal axis; said support section extending a second distance (e) measured in the direction of said longitudinal axis; and, said second distance (e) being less than said first distance (d).

12. A muffler for insertion into a pipe, the muffler comprising:

a base body defining a longitudinal axis and having first and second axial end faces;

said base body having a plurality of pass-through openings formed therein which extend between said first and second end faces in the direction of said longitudinal axis;

said base body having a cylindrical outer surface;

said base body having an appending support section extending therefrom axially beyond said first end face;

said base body having a central through-flow channel; and, said plurality of pass-through openings being disposed around said central through-flow channel at a radial spacing from said central through-flow channel;

said plurality of pass-through openings having a predetermined shape; and, said central through-flow channel having a cross-sectional shape different from the shape of each of said plurality of pass-through openings.

13. A muffler for insertion into a pipe, the muffler comprising:

a base body defining a longitudinal axis and having first and second axial end faces;

said base body having a plurality of pass-through openings formed therein which extend between said first and second end faces in the direction of said longitudinal axis;

said base body having a cylindrical outer surface;

said base body having an appending support section extending therefrom axially beyond said first end face;

said base body having a central through-flow channel; and, said plurality of pass-through openings being disposed around said central through-flow channel at a radial spacing from said central through-flow channel;

said plurality of pass-through openings having a predetermined cross-sectional area; and, said central through-flow channel having a cross-sectional area different from the area of each of said plurality of pass-through openings.

14. A muffler for insertion into a pipe, the muffler comprising:

a base body defining a longitudinal axis and having first and second axial end faces;

said base body having a plurality of pass-through openings formed therein which extend between said first and second end faces in the direction of said longitudinal axis;

said base body having a cylindrical outer surface;

said base body having an appending support section extending therefrom axially beyond said first end face;

said base body having a central through-flow channel; and, said plurality of pass-through openings being disposed around said central through-flow channel at a radial spacing said central through-flow channel; and, each of said plurality of pass-through openings having a slot-shaped cross section.

15. The muffler of claim 14, said pass-through openings being aligned parallel to each other.

* * * * *

UNITED STATES PATENT AND TRADEMARK OFFICE

CERTIFICATE OF CORRECTION

PATENT NO. : 5,714,724
DATED : February 3, 1998
INVENTOR(S) : Johannes Menzel

It is certified that error appears in the above-identified patent and that said Letters Patent is hereby corrected as shown below:

In column 8, line 29: between "spacing" and "said", insert -- from --.

Signed and Sealed this

Twenty-eighth Day of April, 1998

Bruce Lehman

*Attest:*

BRUCE LEHMAN

*Attesting Officer*

*Commissioner of Patents and Trademarks*